US006575448B1

(12) United States Patent
Tokutsu

(10) Patent No.: US 6,575,448 B1
(45) Date of Patent: Jun. 10, 2003

(54) SHEET PROCESSING APPARATUS AND IMAGE FORMING APPARATUS

(75) Inventor: Akihito Tokutsu, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/998,417

(22) Filed: Dec. 3, 2001

(51) Int. Cl.[7] ..... B65H 5/26

(52) U.S. Cl. ..... 271/9.01; 271/9.04; 271/9.08; 271/9.13; 271/3.03

(58) Field of Search ..... 271/9.01, 9.04, 271/9.08, 9.13, 3.03, 162, 184, 185, 186, 9.02, 902, 3.04

(56) References Cited

U.S. PATENT DOCUMENTS 5,738,348 A * 4/1998 Yasue et al. ..... 271/118
6,330,422 B1 * 12/2001 Sato et al. ..... 399/382

FOREIGN PATENT DOCUMENTS

JP 2001-026367 1/2001

* cited by examiner

*Primary Examiner*—Donald P. Walsh
*Assistant Examiner*—Kaitlin Joerger
(74) *Attorney, Agent, or Firm*—Foley & Lardner

(57) ABSTRACT

A sheet processing apparatus of the present invention comprises: an inserter tray to support insert sheets, an insert sheet supply roller to supply the insert sheets in the direction of a recording medium conveying path from the inserter tray; an insert sheet conveying device extending from the insert sheet supply roller to the recording medium conveying path to convey the insert sheets; a sheet reversing/conveying device provided from the insert sheet supply roller to the recording medium conveying path to reverse both the front and back sides of the insert sheets; and a gate to sort the insert sheets supplied from the insert sheet supply roller to the insert sheet conveying device or the insert sheet reversing/conveying device, and supplies insert sheets on the inserter tray by reversing the front and back sides in the direction of recording media according to a type of finish processing to be applied to recording media.

9 Claims, 5 Drawing Sheets

SHEET PROCESSING APPARATUS AND IMAGE FORMING APPARATUS

BACKGROUND OF THE INVENTION

1. Field of the Invention

The present invention relates to a sheet processing apparatus to supply insert sheets for finishing process of sheets with images formed thereon by a copying machine or a printer and an image forming apparatus.

2. Description of the Related Art

In a highly functional image forming apparatus, a finisher is generally provided adjoining to a discharge unit of the main body of the apparatus and paper with an image formed thereon is sorted and accumulated on an accumulation tray of the finisher after such a finishing process as a stapling process or a two-folding process at the center. In recent years, for the finishing process by such a finisher, an image forming apparatus further provided with an inserter near a finisher to supply an insert sheet is used to put an insert sheet that is differing from the paper having the image formed on the paper.

As disclosed in Japanese Patent No. 2001-26367, an inserter supplies insert sheets taken out from an inserter tray directly in the finish processing direction regardless of a type of the finishing process of paper. That is, irrespective of a saddle stitching process or other process, insert sheets are supplied to the finisher while keeping the surfaces that are set on the inserter.

Therefore, when setting insert sheets on the inserter tray, operator had to set insert sheets in the face-up state when the sorting/stapling process is made. On the other hand, insert sheets must be set in the face-down state when the saddle stitch process is made. So, operator had to select the front/back side of insert sheets that are to be set on the inset tray according to the mode of finishing process. Thus, it gave confusion to operator and a time was needed to check the setting direction of insert sheets.

Accordingly, regardless of a difference in the mode of finishing process, it has been desired to make it possible to set insert sheets on the inserter tray with the same surfaces upward so that the operator's confusion when setting insert sheets and reliability as well as operability are improved.

SUMMARY OF THE INVENTION

It is an object of the present invention to provide high reliability and operability in the finishing process without causing confusion regarding the setting surfaces of insert sheets by operator when setting insert sheets on an inserter try.

According to an embodiment of the present invention, a sheet processing apparatus is provided, which comprises: a sheet supporting device to support insert sheets; a supply device to supply the insert sheets in the direction of a recording medium conveying path from the sheet supporting device; a sheet conveying device that is extending from the supply device to the recording medium conveying path to convey the insert sheets; a sheet reversing/conveying device that is provided between the supply device and the recording medium conveying path to reverse the front and back sides of the insert sheets; and a gate to sort the insert sheets supplied from the supply device to either the sheet conveying device or the sheet reversing/conveying device.

Further, according to an embodiment of the present invention, a sheet processing apparatus is provided, which comprises: an inserter tray to support insert sheets; supply rollers to supply insert sheets from the inserter tray in the direction of a recording medium conveying path; a sheet conveying device extending from the supply rollers to the recording medium conveying path to convey insert sheets; a sheet reversing/conveying device provided between the supply rollers and the recording medium conveying path to reverse the front and back sides of insert sheets; and a gate to sort the insert sheets supplied from the supply rollers to either the sheet conveying device or the sheet reversing/conveying device.

Further, according to an embodiment of the present invention, an image forming apparatus is provided, which comprises: an image forming unit to form a fixed toner image on a recording medium; a finisher to finish process the recording medium with the fixed toner image formed thereon by the image forming unit; a recording medium conveying path extending from the image forming unit to the finisher; an inserter tray to support insert sheets; a supply roller to supply the insert sheets from the inserter tray to the direction of the recording medium conveying path; a sheet conveying device extending from the supply roller to the recording medium conveying path to convey the insert sheets; a sheet reversing/conveying device provided between the supply roller to the recording medium conveying path to reverse the front and back sides of the insert sheets; and a gate to sort the insert sheets supplied from the supply roller to either the sheet conveying device or the sheet reversing/conveying device.

DETAILED DESCRIPTION OF THE INVENTION

Figure 1:
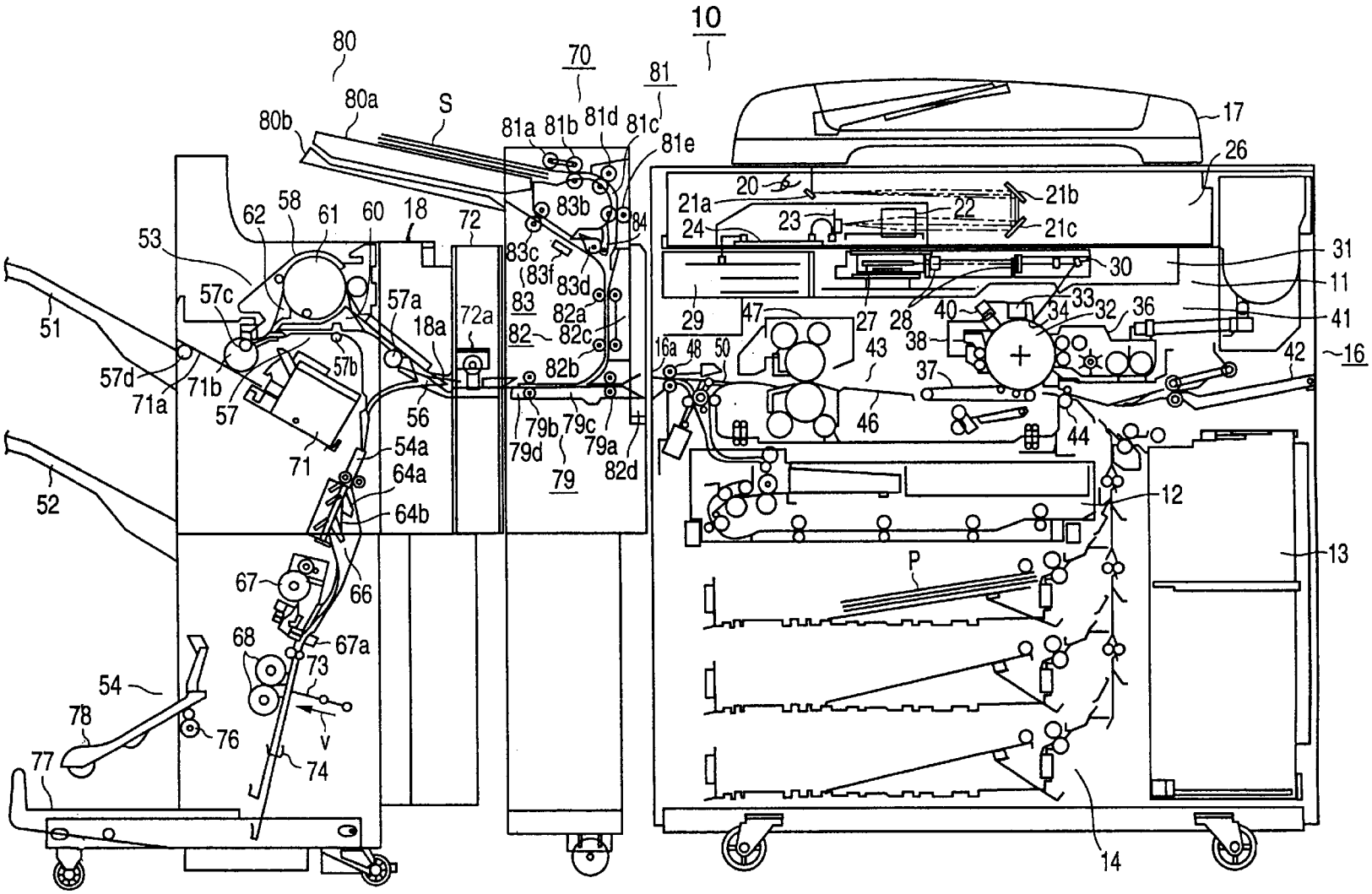
FIG. 1 is a schematic diagram showing a copying machine of an embodiment of the present invention.
Figure 2:
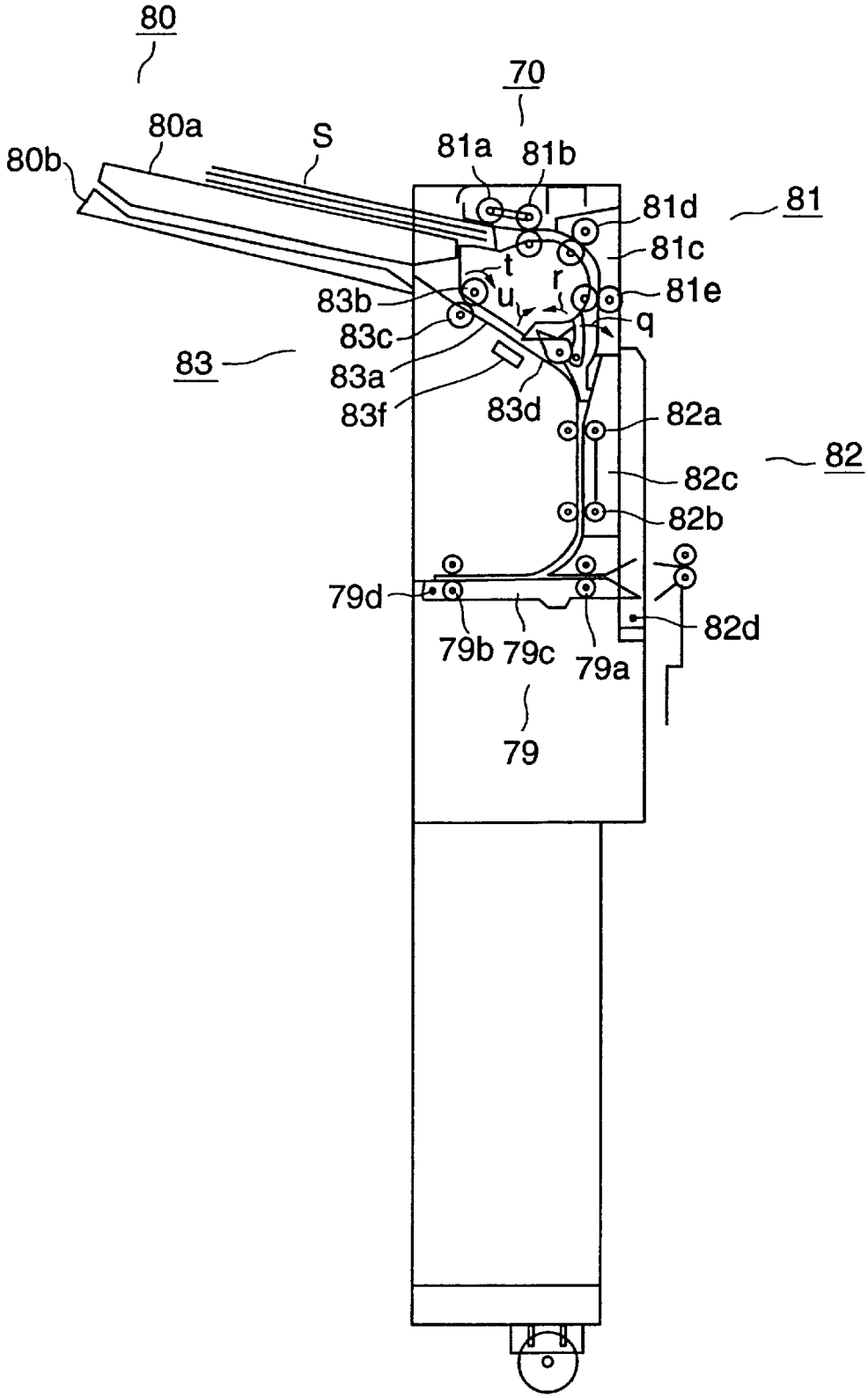
FIG. 2 is a schematic diagram showing an inserter of an embodiment of the present invention.

An embodiment of the present invention will be described schematic diagram showing a copier 10 that is an image forming apparatus of an embodiment of the present invention. The copier 10 has a main body 16 comprising an image forming unit 11, an automatic duplex device 12, a large volume paper feeder 13, and a paper supply unit 14, and an automatic document feeder 17 provided on the top of the main body, and a finisher 18 that is for the finish process and accumulation of paper P with an image formed by the main body 16. Further, the copier 10 has an inserter 70 that is a sheet processor to supply insert sheets S to paper P conveyed to the finisher 18 from the main body 16, and a puncher 72 to perforate binding holes on paper P or the insert sheet S as optional items.

The image forming unit 11 of the main body 16 comprises: a reading optical system unit 26 that is composed of a halogen lamp 20; first through third mirrors 21*a*–21*c;* a focusing portion 22; a CCD pixel 23 that is a reading means, a CCD substrate 24, and a CCD processor 29; a writing optical system 31 that is composed of a laser oscillation element (not illustrated); a polygonal mirror 27; a lens system 28 and a reflecting mirror 30, and an image forming unit 41 that has a charging device 33; an exposing device 34, a developing device 36, a transferring belt 37, a cleaner 38 and a charge eliminator 40 around a photo-conductive drum 32.

Further, in the main body 16, a manual paper supply table 42 and a conveying path 43 to lead paper P supplied from the large volume paper feeder 13 or a paper supply unit 14 to a paper discharge port 16*a* via the photo-conductive drum are formed. An aligning roller pair 44 is arranged at the upper steam side from the photo-conductive drum 32 of this conveying path 43, and a conveying guide 46, a fixing roller pair 47, a paper discharge roller pair 48 and a gate 50 to lead paper P to either the paper discharge roller pair 48 side or the automatic duplex device 12 are arranged at the downstream side.

Next, the finisher 18 and the inserter 70 will be described in detail. At the lead-in unit 18*a* of the finisher 18 to which the main body 16 and the paper P conveying path are connected via a punch unit 72 that has the inserter 70 and the punch portion 72*a,* a saddle stitcher flapper 56 is provided to lead paper P discharged from the paper discharge port 16*a* of the main body 16 to either a conveyor unit 53 that conveys paper P to a vertically movable first or second accumulation trays 51, 52 or a saddle stitcher 54. The conveyor unit 53 has an intermediate path roller pair 57*a,* a conveying path 57 to convey paper P by first and second conveying rollers 57*b,* 57*c* and a paper discharge roller 57*d,* and a buffer path 58 that is provided by branching at the middle of the conveying path 57. The buffer path 58 has an entrance flapper 60, a buffer roller 61 and a winding flapper 62. Further, 71 is a stapler, 71*a* is a processing tray and 71*b* is a knurling belt.

At the lead-in unit 54*a* of the saddle stitcher 54, first and second flappers 64*a,* 64*b* are provided for deciding a paper path according to a size of paper P and further for preventing paper P from being caught when putting paper P in a housing guide 66. On the middle of the housing guide 66, a stitcher 67 and a stitch pad 67*a* for binding the center of paper P are provided at this side and the inner side. At the downstream side of the stitcher 67, a folding roller pair 68, a push plate 73 and further, a paper positioning plate 74 are provided. Further, 76 is a paper discharging guide plate for discharging folded paper P in a paper discharge tray 77 and 78 is a paper discharge guide plate to discharge paper P while suppressing it on the paper discharge tray 77.

Next, the inserter 70 is composed of a lateral conveying path 79 to convey paper P discharged from paper discharge port 16*a* of the main body 16 in the direction of the finisher 18, a tray unit 80 having an inserter tray 80*a* that sets insert sheets S and a reversing tray 80*b* that is a reversing/supporting device formed in one unit with the inserter tray 80*a* to reverse the front and back sides of insert sheets S on the inserter tray 80*a* and support them, a paper feed unit 81 that is a paper supply device to supply insert sheets S one sheet at a time from the tray unit 80, a vertical conveying path 82 that is a sheet conveying unit to convey insert sheets S supplied from the paper feed unit 81 in the direction of the lateral conveying path 79, and a reversing unit 83 that is a sheet reversing and conveying unit to reverse the front and back sides of insert sheets S supplied from the paper feed unit 81. Further, at the downstream side of the paper feed unit 81, there is provided a gate unit 84 that sorts insert sheets S to either the vertical conveying path 82 or the reversing unit 83.

The gate unit 84 is driven and controlled by a controller (not shown) so as to sort insert sheets S to the reversing unit 83 side only when the finishing process of paper P by the finisher 18 is the two-folding process by the saddle stitcher 54 and in the other case, sort insert sheets S to the vertical conveying path 82 side. The paper feed unit 81 has a pick-up roller pair 81*a* and a separation roller pair 81*b* and also, has conveying roller pair 81*d,* 81*e* along the conveying path 81*c*.

The reversing unit 83 has a conveying path 83*a* to convey insert sheets S in the direction of the reversing tray 80*b,* a reversing roller pair 83*b* and 83*c* that are kept in contact with each other to form a reverse conveying roller pair. The reversing roller 83*c* is compressed in the direction of the reversing roller 83*b* by a rotary holder 88 that is oscillatory supported centering around a supporting point 88*d* by a nip spring 88*c*. Further, the reversing unit 83 has a flapper 83*d* that changes the convey of insert sheets S into the reversing unit 83 or the convey out from the reversing unit 83 to the vertical conveying path 82 side and a sensing switch 83*f* to sense passage of insert sheets S. In addition, a conveying roller pair 79*a,* 79*b* is provided along the lateral conveying path 79 and a conveying roller pair 82*a,* 82*b* is provided along the vertical conveying path 82. A lower conveying path 79*c* of the lateral conveying path 79 can be opened or closed centering around a supporting point 79*d* and a wall side conveying path 82*c* of the vertical conveying path 82 can be opened or closed centering around a supporting point 82*d*.

Further, the tray unit 80 is able to rotate the insert tray 80*a* and the reversing tray 80*b* jointly in one unit so as not to interfere the opening/closing operation of an upper cover 18*b* of the finisher 18. At a rotary supporting point 86*a* of the tray unit 80, a supporting point gear 86*b* is provided. The supporting point gear 86*b* rotates a cam-gear 88*a* that has a cam 88*b* for oscillating a roller holder 88 to support the reversing roller 83*c* via an idler gear 87. The cam-gear 88*a* rotates the roller holder 88 by bringing the cam 88*b* in contact with the roller holder 88 and separates the reversing roller 83*c* from the reversing roller 83*b*.

Next, the actions will be described. First, when the key on the control panel (not illustrated) is turned on and the image forming operation is started after inputting required image conditions when forming images, the photo-conductive drum 32 is applied with charging, exposure and developing steps with its rotation and a toner image is formed. On the other hand, at the manual paper feeding table 42, the automatic duplex device 12, a large volume paper feeder 13 or the paper feed unit 14 supplies prescribed paper P to the transferring belt 37 synchronizing with a toner image on the photo-conductive drum 32. A toner image on the photo-conductive drum 32 is transferred on paper P at the position of the transferring belt 37. The toner image on paper P is heated, pressed and fixed in a fixing device 47 and thereafter, the paper P is conveyed through the gate 50 in the direction of the paper discharge roller 48 or the automatic duplex device 12. Further, after completing the image transferring, the photo-conductive drum 32 becomes ready to next copying through the cleaner 38 and the charge eliminator 40 according to its rotation.

Next, the finish processing of paper P that is discharged from the paper discharge roller 48 after the image process by the main body 16 will be described. When the finish processing is executed using an insert sheets S, insert sheets S are set in the face-up state with the surface upward in the inserter tray 80*a* when starting the image forming operation. Further, when paper P is two-folded using the saddle stitcher unit 54 in the finishing process, the image forming operation is started by turning the start key on after keying in the saddle stitch processing through the control panel (not shown).

When the saddle stitch processing is keyed in through the control panel, a gate 84 of the inserter 70 is pressed against the arrow direction q and it becomes possible to sort insert sheets S to the reversing unit 83 side. In the case of other than the saddle stitch processing, the gate 84 of the inserter 70 is pressed in the arrow direction r and it becomes possible to sort insert sheets S to the vertical conveying path 83 side.

In the saddle stitch processing, paper P discharged from the main body 16 side passes through the inverter 70 and the punch unit 72 and conveyed into the finisher 18 from the carry-in port 18*a*. Then, paper P is sorted to the saddle stitcher unit 54 side by the saddle stitcher flapper 56 and housed in the housing guide 66 in order via the first or second flappers 64*a*, 64*b* according to size of paper P.

On the other hand, synchronizing with completion of the discharge of paper P from the main body 16 side, insert sheets S on the top position in the inserter tray 80*a* are taken out by the pick-up roller 81*a*, separated one by one by the separation roller 81*b* and conveyed to the gate 84 by the conveying rollers 81*d*, 81*e*. Then, the inset sheets S are sorted in the direction of the reversing unit 83 by the gate 84 that is pressed in the arrow direction q, clamped and conveyed by the reversing roller 83*b* that is rotated in the arrow direction t and the free rotating roller 83*c* and led in the direction of the reversing tray 80*b*. The insert sheet S are supported in the reversed state on the inserter tray 80*a*.

Hereafter, the trailing edges of the insert sheets S are detected by the switch 83*f*, the reversing roller 83*b* is rotated in the direction reverse to the arrow direction t and the flapper 83*d* is pressed in the arrow direction u, and insert sheets S are conveyed to the vertical conveying path 82 side in the front and back sides reversed state. The insert sheets S are further conveyed into the finisher 18 from the carry-in unit 18*a* in the face-up state through the lateral conveying path 79 and the punch unit 72 by the conveying rollers 82*a*, 82*b* and the conveying rollers 79*a*, 79*b*. Hereafter, the insert sheets S are sorted to the saddle stitcher unit 54 side by the saddle stitcher flapper 56 similar to paper P, and housed in the housing guide 66 through the first or the second flapper 64*a*, 64*b* according to size of paper P and piled up on paper P.

In the housing guide 66, paper P and insert sheets S are positioned by the paper positioning plate 74 that is moved up/down according to size of paper/sheet so that the center fits to the binding position of the stitcher 67. When all paper P and insert sheets S are housed in the housing guide 66, the central portions of paper P and insert sheets S are stitched by the stitcher 67. Then, the center of a bundle of paper P and insert sheets S is conveyed in the direction of the folding rollers 68 by pushing them in the arrow direction v by the pushing plate 73. The paper and insert sheets S are folded in two by clamping between the folding rollers 68 and discharged on a paper discharge tray, and the saddle stitching processing is completed.

Next, the finish processing other than the saddle stitch processing using insert sheets S, for example, a stapling process will be described. In this case, the gate 84 of the inserter 70 is pressed in the arrow direction r and is able to sort insert sheets S to the vertical conveying path 82 side. First, insert sheets S at the top position are taken out by the pick-up rollers 81*a* before paper P is discharged from the main body 16 side, separated one by one by the separation rollers 81*b* and conveyed to the gate 84 by the conveying rollers 81*d*, 81*e*. Then, the insert sheets S are sorted in the direction of the vertical conveying path 82 and conveyed into the finisher 18 from the carry-in unit 18*a* through the lateral conveying path 79 and the punch unit 72 by the conveying rollers 82*a*, 82*b* and 79*a*, 79*b*.

Then, the insert sheets S are sorted to the conveying unit 53 side by the saddle stitcher flapper 56, passed the conveying path 57 through an intermediate pass roller 57*a* and an entrance flapper 60 and placed in, for example, a first accumulation tray 51 and a process tray 71*a* in the face-down state. Then, paper P discharged from the main body 16 side passes through the punch unit 72 and conveyed into the finisher 18 through the carry-in unit 18*a*. The paper P is further sorted to the conveying unit 53 side by the saddle stitcher flapper similar to the insert sheets S, and passing the conveying path 57 via the entrance flapper 60, are put on the insert sheets S in order in the first accumulation tray in the face-down state. When all the paper P and the insert sheets S are put on the first accumulation tray 51 and the processing tray 71*a*, the paper P and the invert sheets S are aligned and after stapled by the stapler 71, dischearged on the first accumulation tray 51 by the knurling belt 71*b* and the stapling process is completed.

Figure 3:
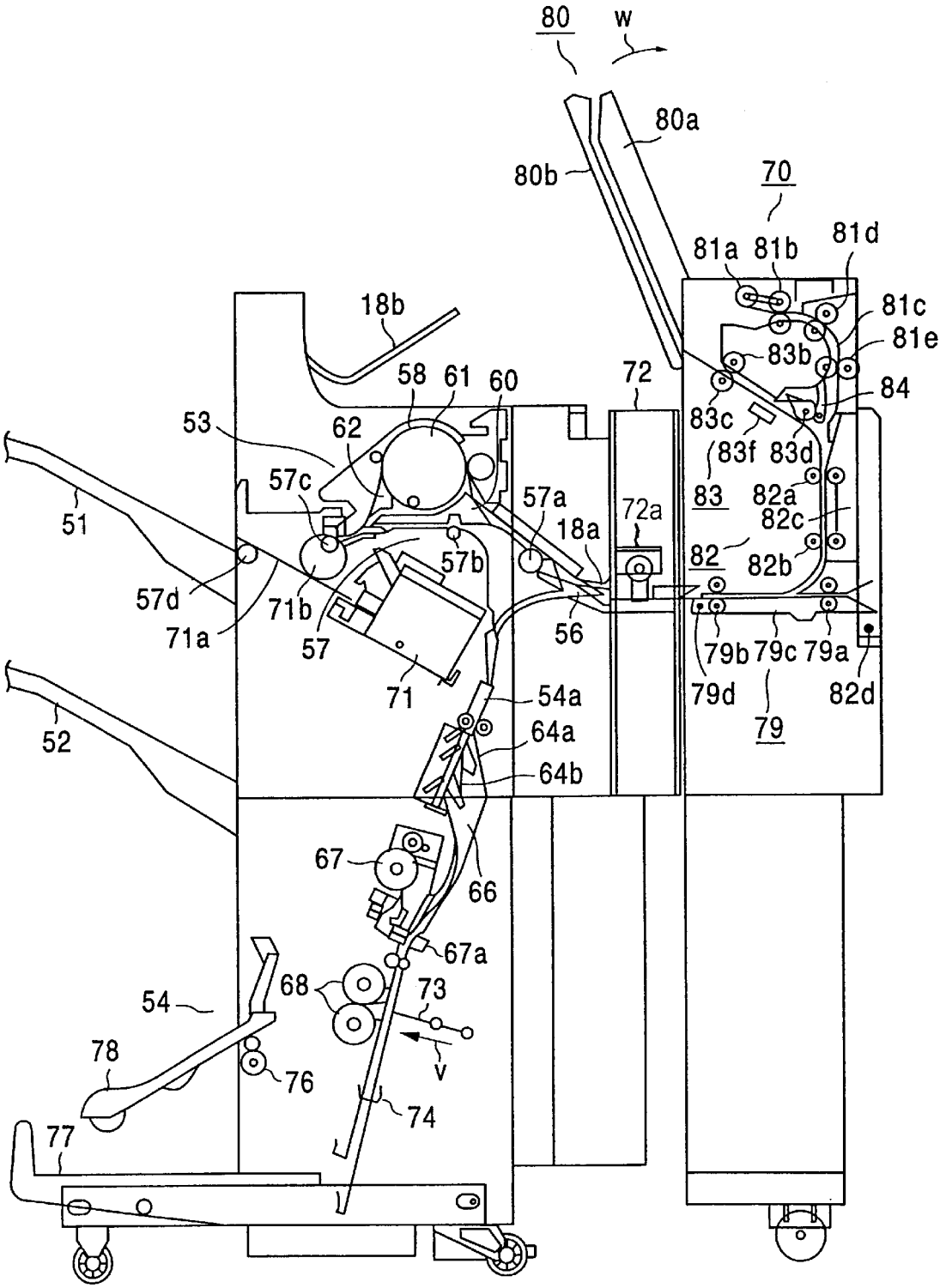
FIG. 3 is a diagram for roughly explaining an inserter with the top cover opened in an embodiment of the present invention.
Figure 4:
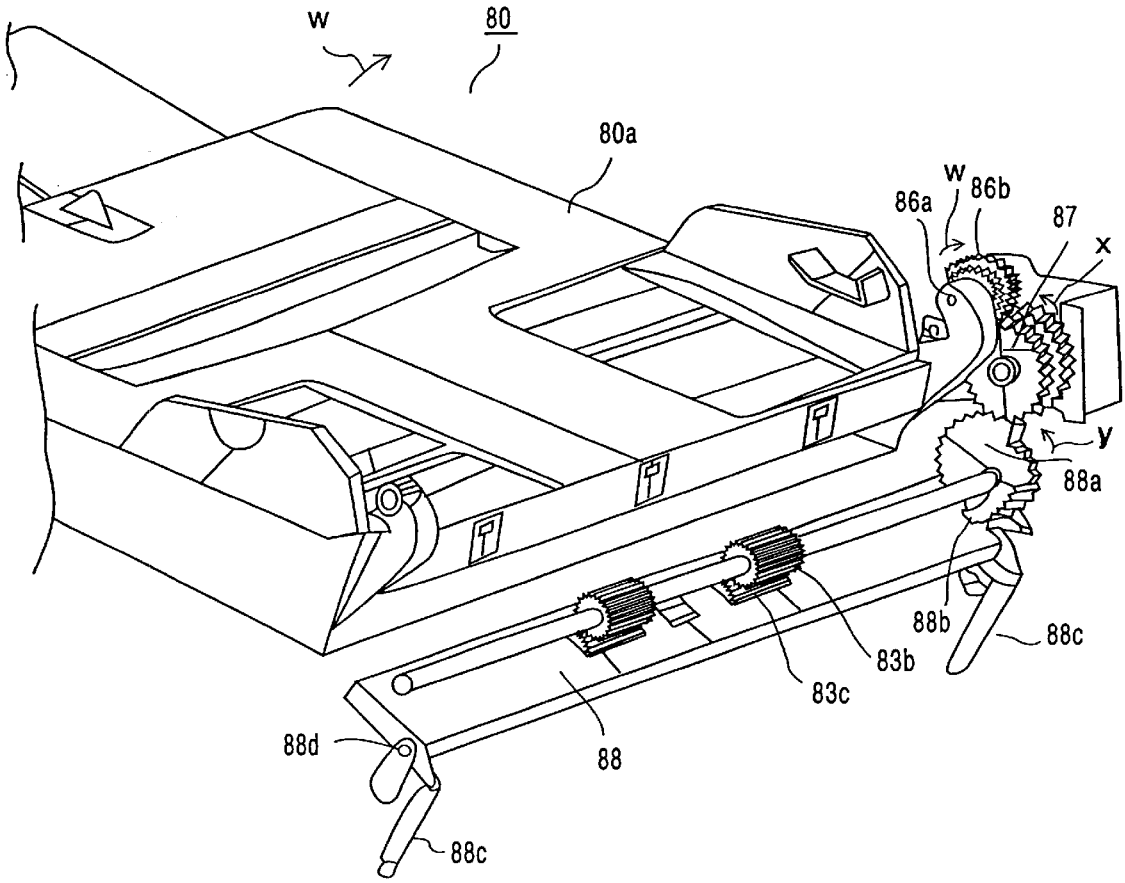
FIG. 4 is a perspective view roughly showing a part of a tray unit of an embodiment of the present invention.
Figure 5:
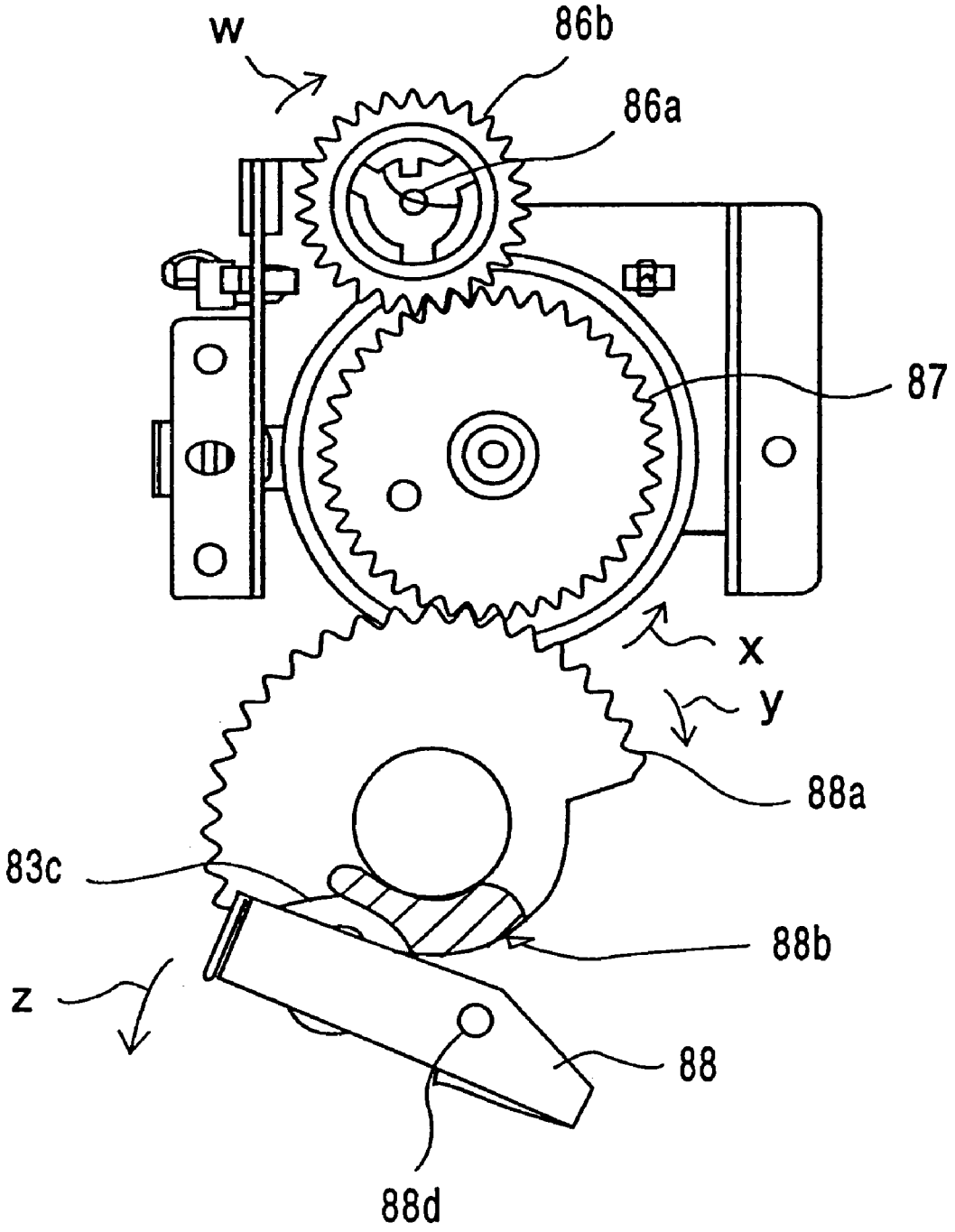
FIG. 5 is a diagram for roughly showing reversing rollers and release of nip of reversing rollers.

While the finish processing is being executed, if it becomes necessary to open or close the upper cover 18*b* of the finisher 18, for example, in order to remove jammed sheets in the finisher, turn the upper cover 18*b* upward after rotating the inserter tray 80*a* of the inserter 70 in the arrow directions w as shown in FIG. 3.

Further, when the inserter sheets S are jammed in the inserter 70, open the conveying path of the insert sheets S according to the jam generating point. That is, when the sheets are jammed in the vertical conveying path 82, separate the inserter 70 from the main body 16, open the vertical conveying path 82 by rotating the wall side and remove the jammed sheet. When the jamming occurred in the lateral conveying path 79 similarly, open the lateral conveying path 79 by rotating the lower conveying path 79*c* and remove the jammed sheet.

On the other hand, when the jamming occurred in the reversing unit 83, rotate the inserter tray 80*a* in the arrow direction w from the insert sheet S settable state when used. As a result of the rotation of the supporting point gear 86*b* in the arrow direction w pursuant to the rotation of this inserter tray 80*a* in the arrow direction w, the idler gear 87 is rotated in the arrow direction x and the cam-gear 88*a* is rotated in the arrow direction y. With the rotation of the cam-gear 88*a* in the arrow direction y, the cam 88*b* of the cam-gear 88*a* that was kept separated from a roller holder 88 when the insert sheets S were in the settable state is brought in contact with the roller holder 88 and rotates the roller holder 88 in the arrow direction z centering around the supporting point 88*d*. As a result of the rotation of the roller holder 88 in the arrow direction z, the reversing roller 83*c* is separated from a reversing roller 83*b*. So, when the nip between the reversing rollers 83*b* and 83*c* is removed and the conveying path of the reversing unit 83 is opened, the jammed sheet S can be removed from the inserter tray 80*a* side or the reversing tray 80*b* side.

When constructed as described above, the insert sheets S are supplied to the saddle stitcher unit 54 after the reversing process in the reversing unit 83 in the inserter 70 when the finish processing is the saddle stichin process. On the other hand, when the case of the finish processing is other than the saddle stitch processing, the insert sheets S can be supplied to the conveying unit 53 without reversing them. Accordingly, irrespective of the finishing process being the saddle stitching process or other process, the operator is only required to set insert sheets S in the face-up state whenever setting the insert sheets S in the inserter tray 80*a* and it becomes possible to set insert sheets S without confusion, prevent setting error and improve reliability of the finishing process.

Further, when constructed as described above, the nip between the reversing rollers 83*b* and 83*c* can be removed accompanied with the rotation of the inserter tray 80*a*. In particular, in the jam processing of a large insert sheet S extending over the inserter tray 80*a* and the reversing tray 80*b*, it becomes possible to make the jam processing easily without breaking paper in the midway of the path and a sheet of paper left in the reversing unit 83. Furthermore, as the inserter tray 80*a* and the reversing tray 80*b* can be rotated jointly, it becomes possible to make the jam processing smoothly in the finisher 18 without being interfered by the inserter tray 80*a* when opening or closing the upper cover 18*b* of the finisher.

Further, the present invention is not restricted to the embodiment described above but can be modified without departing from the spirit and scope thereof. For example, the reversing operation of insert sheets is not limited only to the key-in operation of the saddle stitch process but also can be made on the control panel or by a changeover switch provided on the inserter. In addition, the insert timing of insert sheets by the inserter is optional and plural sheets can be inserted optionally during one finishing process and kinds of the finishing process using the inserter are not limited. Further, the conveying path of insert sheets of the reversing unit is also optional and a buffer tray may be provided in the inside of the inserter without providing a reversing tray at the outside of the inserter.

What is claimed is:

1. A sheet processing apparatus comprising:

a sheet supporting device to support insert sheets, the sheet supporting device being rotatable;

an insert sheet supply device to supply insert sheets in the direction of a recording medium conveying path from the sheet supporting device;

a sheet conveying device extending from the insert sheet supply device to the recording medium conveying path to convey the insert sheets;

a sheet reversing/conveying device provided between the supply device to the recording medium conveying path for reversing both sides of the insert sheets, the sheet reversing/conveying device having a reversing/supporting device to support insert sheets on the sheet supporting device by reversing both sides, a reversing/conveying path extending from the insert sheet supply device to the reversing/supporting device, and a reversing/conveying roller pair provided in the reversing/conveying path to convey the insert sheets by clamping them, wherein the reversing/supporting device is rotatable jointly with the sheet supporting device; and a gate to sort the insert sheets supplied from the supply device to either the sheet conveying device or the sheet reversing/conveying device.

2. A sheet processing apparatus according to claim 1, wherein:

the gate sorts the insert sheets to the sheet reversing/conveying apparatus side when the recording medium finishing process mode is the saddle stitching process mode.

3. A sheet processing apparatus according to claim 1, wherein a nip between the reversing/conveying roller pair is removable with the rotary operation of the sheet support device.

4. A sheet processing apparatus comprising:

an inserter tray to support insert sheets, the insert tray being rotatable;

an insert sheet supply roller to supply the insert sheets from the inserter tray to the direction of a recording medium conveying path;

a sheet conveying device extending from the sheet supply roller to the recording medium conveying path to convey the insert sheets;

a sheet reversing/conveying device provided between the sheet supply roller to the recording medium conveying path to reverse both sides of the insert sheets, the sheet reversing/conveying device has a reversing tray to reverse both sides of the insert sheets on the inserter tray and to support them; a reversing path extending from the supply roller to the reversing tray; and a reversing/conveying roller pair provided in the reversing path to convey the insert sheets by clamping them, wherein the reversing tray rotates jointly with the inserter tray; and a gate to sort the insert sheets supplied by the supply roller either to the sheet conveying device or to the sheet reversing/conveying device.

5. A sheet processing apparatus according to claim 4, wherein the gate sorts the insert sheets to the sheet reversing/conveying device side when the recording medium finish processing mode is the saddle stitch processing mode.

6. A sheet processing apparatus according to claim 4, wherein a nip between the reversing/conveying roller pair is removable with the rotating operation of the inserter tray.

7. An image forming apparatus comprising:

an image forming unit to form a fixed toner image on a recording medium;

a finisher to finish process the recording medium having the fixed toner image formed by the image forming unit;

a recording medium conveying path extending from the image forming unit to the finisher;

an inserter tray to support insert sheets, the inserter tray being rotatable;

a supply roller to supply the insert sheets in the direction of the recording medium conveying path from the inserter tray;

a sheet conveying device extending from the supply roller to the recording medium conveying path to convey the insert sheets;

a sheet reversing/conveying device provided between the supply roller to the recording medium converting path to reverse both sides of the insert sheets, the sheet reversing/conveying device including a reversing tray to reverse both sides of the insert sheets on the inserter tray and to support them, a reversing path extending from the supply roller to the reversing tray, and a reversing/conveying roller pair provided in the reversing path to convey the insert sheets by clamping them, wherein the reversing tray is rotatable jointly with the inserter tray; and a gate to sort the insert sheets supplied from the supply roller to either the sheet conveying device or the sheet reversing/conveying device.

8. An image forming apparatus according to claim 7, wherein the gate sorts the insert sheets to the sheet reversing/conveying device side when the finish process by the finisher is the saddle stitch process.

9. An image forming apparatus according to claim 7, wherein a nip between the reversing/conveying roller pair is removable with the rotation of the inserter tray.

* * * * *